United States Patent [19]

Wiegard et al.

[11] Patent Number: 4,551,396

[45] Date of Patent: Nov. 5, 1985

[54] SLIDING MATERIAL FOR SEALS ON ROTARY REGENERATIVE HEAT EXCHANGERS WITH A CERAMIC CORE

[75] Inventors: Klaus Wiegard, Esslingen; Karlheinz Kinast, Plochingen; Wolfgang Kleinekathöfer, Waldstetten; Eggert Tank, Wernau, all of Fed. Rep. of Germany

[73] Assignee: Daimler-Benz Aktiengesellschaft, Stuttgart, Fed. Rep. of Germany

[21] Appl. No.: 647,239

[22] Filed: Sep. 4, 1984

[30] Foreign Application Priority Data

Sep. 3, 1983 [DE] Fed. Rep. of Germany ..... 3331919

[51] Int. Cl.[4] ..... B32B 15/18

[52] U.S. Cl. ..... 428/678; 428/629; 420/442; 252/25; 501/153

[58] Field of Search ..... 428/678; 420/442

[56] References Cited

U.S. PATENT DOCUMENTS

| | | | |
|---|---|---|---|
| 3,481,715 | 12/1969 | Whalen et al. | 428/629 |
| 3,679,459 | 7/1972 | Rao et al. | 252/25 |
| 3,746,352 | 7/1973 | Bao et al. | 501/153 |
| 4,387,140 | 6/1983 | Kondo et al. | 428/678 |

*Primary Examiner*—Veronica O'Keefe

*Attorney, Agent, or Firm*—Barnes & Thornburg

[57] ABSTRACT

The use of an alloy composed of 15 to 19% by weight of Cr, 5 to 32.5% by weight of Mo, 0.3 to 10% by weight of Si, up to 10% by weight of Al and up to 4.5% by weight of Ti, the remainder being Ni, as a sliding material for seals on rotary regenerative heat exchangers with a ceramic core is described. The sliding material is suitable especially for use in temperature ranges up to about 1100° C.

6 Claims, 1 Drawing Figure

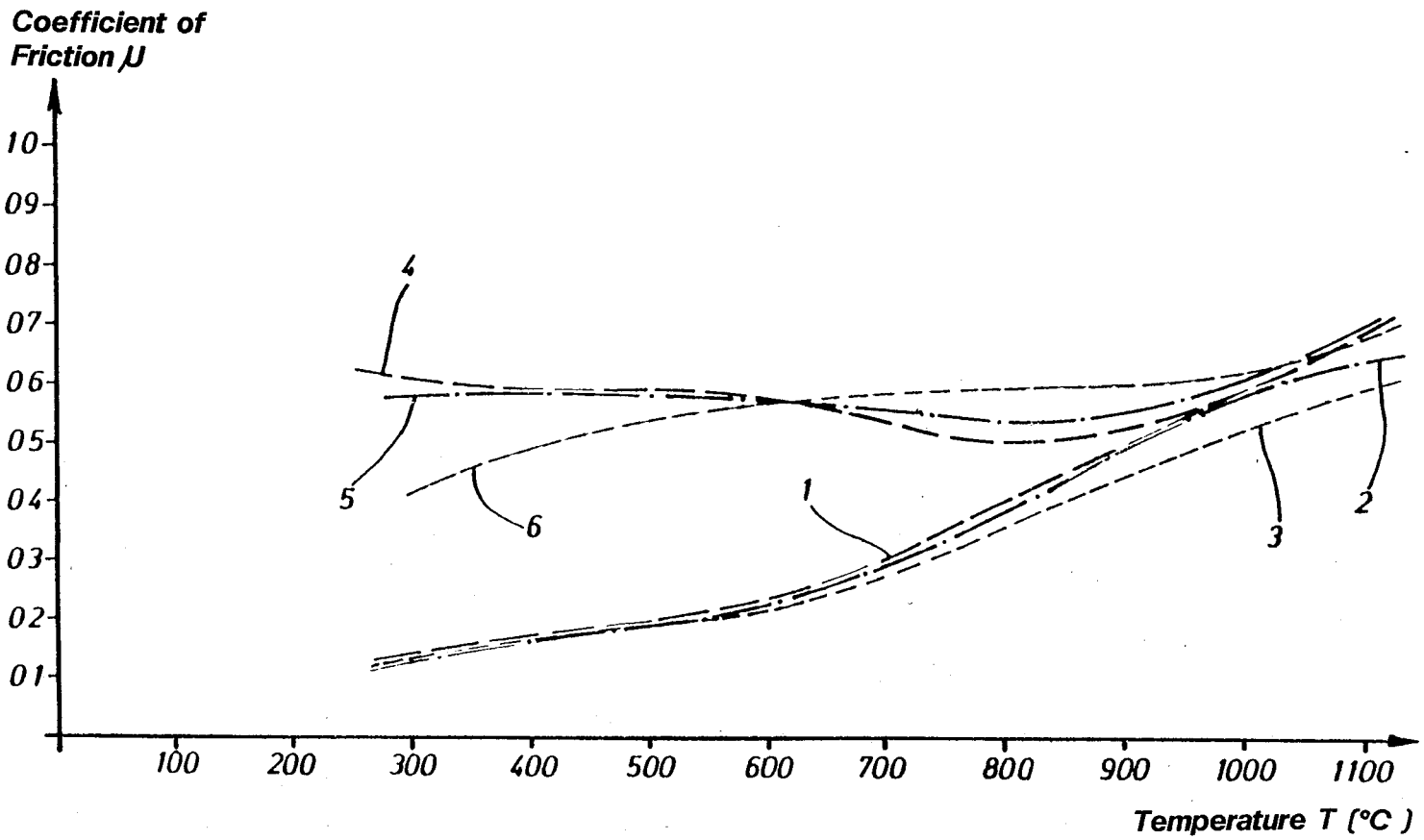
Coefficient of Friction μ
10
09
08
07
06
05
04
03
02
01
100
200
300
400
500
600
700
800
900
1000
1100
Temperature T (°C)
1
2
3
4
5
6

SLIDING MATERIAL FOR SEALS ON ROTARY REGENERATIVE HEAT EXCHANGERS WITH A CERAMIC CORE

BACKGROUND AND SUMMARY OF THE INVENTION

To increase the efficiency of motor vehicle gas turbines, it is customary to recover a part of the heat energy contained in the exhaust gas by means of regeneratively operating heat exchangers. The heat exchangers include ceramic discs which are driven in rotation. The ceramic discs rotate through between open branches of the exhaust pipe and open branches of the pipe for the compressed combustion air, so that the discs are alternately heated and cooled in sectorial zones corresponding to a heating zone and a cooling zone. Details of this arrangement are known to those skilled in the art and can be taken, for example, from the following publications: German Published Unexamined Application No. 2,252,113; German Published Unexamined Application No. 2,301,222; German Published Unexamined Application No. 2,313,165; U.S. Pat. Nos. 3,273,904; 3,456,518 and 3,351,129. However, sealing the rotary heat exchangers causes considerable difficulties. The sliding materials of the seal must not only be able to withstand rapid and large temperature changes, but must also be resistant to oxidative attack at high temperatures and exhibit low wear characteristics. Ceramic sliding materials for this purpose are known, which usually contain one or more metal oxides as well as one or more flourides of alkaline earth metals or alkali metals. They can be roughly divided into three groups:

(a) sliding materials based on nickel oxide with calcium fluoride or a mixture of calcium fluoride and alkaline earth metal halides (for example, German Patent Specification No. 2,202,180; U.S. Pat. Nos. 3,481,715; and 3,746,352);

(b) Sliding materials based on copper or on copper oxide alkaline earth metal fluoride and alkali metal fluoride (U.S. Pat. Nos. 3,746,352 and 3,887,201);

(c) Sliding materials based on zinc oxided and calcium fluoride, it being possible for a part of the zinc oxide to be replaced by tin dioxide or manganese oxides (U.S. Pat. No. 3,679,459; German Published Unexamined Application No. 2,454,654 and German Published Unexamined Application No. 2,514,005).

It is, however, a disadvantage of these sliding materials that they are no longer suitable without restriction for temperatures above 900° C. At these temperatures, all the sliding materials mentioned have at least one of the following disadvantages: high coefficient of friction, inadequate oxidation resistance, poor matching of the coefficient of thermal expansion to that of the substrate, high wear, resintering and hence shrinkage and peeling in operation, poor adhesion to the base material, deterioration of the adhesion during operation due to temperature changes and vibrations, involve complicated preparation of the seals (soldering to a base layer, spraying-on of an adhesive layer), difficult machining required (extremely careful grinding), difficult handling (brittle ceramic layers), expensive and involved production of the spraying powder from materials, some of which are toxic (nickel oxide, fluorides of the alkaline earth metals), impossibility of repairs when the layer of sliding material is locally damaged or worn, immediate destruction on overstress in operation, and large overall height of the seals due to large layer thicknesses.

Since the efficiency of gas turbines can be considerably increased by raising the gas temperature, it is an object of this invention to discover sliding materials for the highest possible operating temperatures.

This object is achieved by sliding material formed according to the invention as an alloy of the composition Cr 15–19% by weight
Mo 5–32.5% by weight
Si 0.3–1% by weight
Fe≦10% by weight
Al≦4.5% by weight
Ti≦4.5% by weight
Ni remainder Surprisingly, it has been found that, in the high temperature range up to a gas temperature of about 1200° C. or a component temperature of about 1100° C., a metallic material possesses essentially better sliding properties and a longer service life than the materials hitherto used for this purpose and having a oxide-flouride structure. The metallic material used as the sliding material is a nickel alloy with 15 to 19% by weight of chromium, 5 to 32.5% by weight of molybdenum, 0.3 to 10% by weight of silicon and up to 10% by weight of iron, which may also contain small quantities of cobalt, up to 4.5% by weight of aluminum and up to 4.5% of titanium, the remainder being nickel.

The advantageous properties of this alloy as a high-temperature sliding material are probably based on the formation of a stable slidable oxide layer which at the same time protects the metal located below from further oxidation; the chromium content of the alloy should here be the higher, the higher the intended use temperature. The processed state of the alloys—casting, semi-fabricated sheet or as a sprayed layer on a substrate—is of subordinate importance for the production and functioning of the sliding material. Thus, for example, a sealing strip can consist, as a composite structure, of a high-temperature alloy as the substrate with a layer of the alloy indicated, sprayed on to the substrate. By means of a subsequent or intermediate heat treatment, the adhesive strength of a plasma-sprayed alloy can be increased and, at the same time, the coefficient of friction in the running-in phase can be lowered. Due to the wear resistance coupled with good slidability of the sliding layer according to the invention, and due to the hardness of the metal matrix located below, only a small layer thickness of the sliding material is required. Locally worn sliding layers can be made functional again by a new coating in the areas concerned.

However, it is also possible to make the entire seal from the solid sliding material, which then acts at the same time as a structural element, thus permitting a small component height.

Compared with the ceramic sliding materials hitherto used, a sliding layer of the sliding material according to the invention shows smoother running even at low temperatures. Likewise, suddenly appearing peak loads do not cause damage and hence a possible destruction of the sliding layer, since the alloy is sufficiently ductile. A further advantage is the higher heat conductivity inherent in metallic materials. On the sealing strip, this higher heat conductivity leads to improved distribution of the temperature stress, which is determined by the operating conditions and differs locally, and thus results in a reduction of temperature peaks. Moreover, the heat can be more satisfactorily removed, under some circumstances. The wear of the ceramic matrix, on which the sliding material slides, is only very small; for instance, at temperatures of 950° C., the mean wear of a matrix made of ceramics, commercially available under the name Cercor, is only about 1 mm in a running period of 500 hours. The wear of the metallic sliding material is extremely small and on average amounts to about 0.5 μm/hour.

Further objects, features, and advantages of the present invention will become more apparent from the following description when taken with the accompanying drawing which shows, for purposes of illustration only, a graphical depiction of the friction coefficient as a function of temperature of two embodiments constructed in accordance with the present invention.

DESCRIPTION OF THE DRAWING AND SPECIFIC EMBODIMENTS

The single drawing FIGURE is a graph comprising the coefficients of sliding friction as a function of temperature for sliding seals constructed with alloys formed according to the present invention.

Following is a description of examples of preferred embodiments constructed according to the present invention. A 0.2 mm thick layer of the metallic sliding material is applied by plasma-spraying to a sealing strip of Nimonic high-temperature alloy. Subsequently, the coefficient of friction of the sliding material against a ceramic matrix (tradename Cercor) was determined at various temperatures and stresses. The results are shown in the FIGURE. Two different alloys were used as the sliding material:

Alloy (a) of a composition
- Cr 15.6% by weight
- Mo 32.0% by weight
- Si 3.5% by weight
- Fe 3.0% by weight
- Ni remainder, and sliding material alloy (b)
- Mo 32.0% by weight
- Cr 15.0% by weight
- Si 3.0% by weight
- Ni remainder The measurements were in each case carried out under a stress of 1.3 N/cm$^2$ (N-Newton); 2.7 N/cm$^2$ and 4.1 N/cm$^2$. The curves 1, 2 and 3 show the coefficients of friction obtained with the sliding material of alloy (a) under a stress of 1.3, 2.7 and 4.1 N/cm$^2$ respectively, curves 4, 5 and 6 show the coefficients of friction of the alloy (b), likewise under a stress of 1.3, 2.7 and 4.1 N/cm$^2$ respectively.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. Sliding material for seals on rotary regenerative heat exchangers with a ceramic core formed as an alloy of the composition
- Cr 15–19% by weight
- Mo 5–32.5% by weight
- Si 0.3–10% by weight
- ≦10% by weight
- ≦4.5% by weight
- Ti ≦4.5% by weight
- Ni remainder

2. Sliding material according to claim 1, wherein said alloy has the composition
- Cr 15.6% by weight
- Mo 32.0% by weight
- Si 3.5% by weight
- Fe 3.0% by weight
- Ni remainder

3. Sliding material according to claim 1, wherein said alloy has the composition
- Mo 32.0% by weight
- Cr 15.0% by weight, and
- Si 3.0% by weight
- Ni remainder

4. A ceramic core seal arrangement for a rotary regenerative heat exchanger comprising a sealing strip of Nimonic high temperature alloy coated by plasma-spraying with sliding material formed of an alloy of the composition
- Cr 15–19% by weight
- Mo 5–32.5% by weight
- Si 0.3–10% by weight
- Fe 10% by weight
- Al 4.5% by weight
- Ti 4.5% by weight
- Ni remainder

5. A seal, according to claim 4, wherein said alloy has the composition
- Cr 15.6% by weight
- Mo 32.0% by weight
- Si 3.5% by weight
- Fe 3.0% by weight
- Ni remainder

6. A seal, according to claim 4, wherein said alloy has the composition
- Mo 32.0% by weight
- Cr 15.0% by weight
- Si 3.0% by weight
- Ni remainder

* * * * *

UNITED STATES PATENT AND TRADEMARK OFFICE

CERTIFICATE OF CORRECTION

PATENT NO. : 4,551,396

DATED : November 5, 1985

INVENTOR(S) : Klaus Wiegard, et al.

It is certified that error appears in the above-identified patent and that said Letters Patent is hereby corrected as shown below:

Column 2: line 22, change "a" to --an--

Column 4: line 12, before "≦" add --Fe-- line 13, before "≦" add --Al--.

Signed and Sealed this

*Fourteenth* Day of *January 1986*

[SEAL]

*Attest:*

DONALD J. QUIGG

*Attesting Officer*

*Commissioner of Patents and Trademarks*